US008509641B2

(12) United States Patent
Kagami

(10) Patent No.: US 8,509,641 B2
(45) Date of Patent: Aug. 13, 2013

(54) ELECTROPHOTOGRAPHIC PRINTING DEVICE AND IMAGE FORMING APPARATUS

(75) Inventor: Takashi Kagami, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 214 days.

(21) Appl. No.: 13/064,245

(22) Filed: Mar. 14, 2011

(65) Prior Publication Data

US 2011/0222891 A1 Sep. 15, 2011

(30) Foreign Application Priority Data

Mar. 15, 2010 (JP) ..... 2010-058490

(51) Int. Cl.
*G03G 15/20* (2006.01)

(52) U.S. Cl.
USPC ..... 399/69; 399/44; 399/45; 399/67

(58) Field of Classification Search
USPC ..... 399/69, 45, 67, 44, 94
See application file for complete search history.

(56) References Cited

U.S. PATENT DOCUMENTS

2005/0207773 A1* 9/2005 Nakayama ..... 399/69

FOREIGN PATENT DOCUMENTS

| | | | |
|---|---|---|---|
| JP | 05-333624 A | * | 12/1993 |
| JP | 05-333740 A | * | 12/1993 |
| JP | 10-198215 A | * | 7/1998 |
| JP | 2004184621 A | | 7/2004 |
| JP | 2008-122780 A | * | 5/2008 |
| JP | 2011-043734 A | * | 3/2011 |

OTHER PUBLICATIONS

Abstract of JP 2004-184621 published Jul. 2, 2004.

* cited by examiner

*Primary Examiner* — Sophia S Chen
(74) *Attorney, Agent, or Firm* — Harness, Dickey & Pierce, P.L.C.

(57) ABSTRACT

An electrophotographic printing device includes a fixing unit; and a temperature sensor. The fixing unit includes: a fixing member; a pressing member pressed against the fixing member; and a heater which heats at least the fixing member of the fixing member and the pressing member, the fixing unit fixing a toner image on a recording material to the recording material while carrying the recording material through a fixing nip formed between the fixing member and the pressing member. The temperature sensor is attached to a recording material supplying unit, and detects a temperature of a recording material stored in the recording material supplying unit, and a fixing temperature is controlled based on the detected temperature.

14 Claims, 8 Drawing Sheets

CONVENTIONAL ART

ELECTROPHOTOGRAPHIC PRINTING DEVICE AND IMAGE FORMING APPARATUS

CROSS-REFERENCE TO RELATED APPLICATIONS

The present application claims priority to and incorporates by reference the entire contents of Japanese Patent Application No. 2010-058490 filed in Japan on Mar. 15, 2010.

BACKGROUND OF THE INVENTION

1. Field of the Invention

The invention relates to a printing device used in an image forming apparatus including a printer, a copying machine, a plotter, and a facsimile, and to the image forming apparatus. The printing device performs printing by causing a pressing member to come into pressure contact with a fixing member to form a nip between the fixing member and the pressing member, and by causing a recording material to pass through the nip to fix a toner image on the recording material.

2. Description of the Related Art

According to a conventional electrophotographic printing device, an electrostatic latent image corresponding to an original image is formed first on a photosensitive element. Then, a visible toner image formed from the electrostatic latent image is transferred onto a recording material, and the transferred toner image is fixed by a fixing unit on the recording material to obtain a permanent toner image.

A fixing unit used in the printing device functions to obtain a permanent toner image by pressing and heating an unfixed toner image formed on a surface of a recording material. Fixing temperature control shown in FIG. 11 is conventionally conducted during the pressing and heating.

The fixing temperature control uses a paper type (coated paper or uncoated paper) and a paper thickness as parameters. An actual situation is that an operator sets a paper type and a paper thickness to select a fixing temperature set in advance for the data thereby determined, and the selected fixing temperature is corrected or changed. Environmental temperatures (temperatures inside and outside the device) are generally acquired by a sensor placed in the device in addition to the aforementioned paper type and the paper thickness. Then, in order to respond to the environment in which the printing device is placed (actual temperature), a reference fixing temperature (temporary value) is corrected to reach a controlled fixing temperature (determined value) as a target value. More specifically, in a relatively high-temperature environment during summer, a fixing temperature is lowered by correction for high temperature (temperature lowering correction for the fixing temperature to fall within an allowable temperature range). In a relatively low-temperature environment during winter, a fixing temperature is raised by correction for low temperature (temperature raising correction for the fixing temperature to fall within an allowable temperature range). As described above, the printing device is operated such that a permanent toner image is formed on a recording material by using a fixing unit that operates while a fixing temperature is maintained to fall within an allowable temperature range.

An allowable temperature range within which favorable fixing is realized is predetermined as a favorable range of fixing between cold offset and hot offset. The cold offset is a phenomenon where toner sticks to a fixing roller or a belt, or toner is not fixed on a recording material sufficiently due to a low fixing temperature. The hot offset is a phenomenon where adhesion between toners is reduced due to a too high fixing temperature to cause reattachment of the toners to a fixing roller or a belt.

Japanese Patent Application Laid-open No. 2004-184621 discloses an image forming apparatus with a fixing unit. The fixing unit includes an element 3 to be heated by heating elements 2A and 2B, and a fixing film 4 heated by the element 3 to be heated. The fixing film 4 and a pressing roller 5 are caused to come into contact with the element 3 to be heated to form a nip N therebetween for fixing a recording material. The heating elements 2A and 2B on the element 3 to be heated are operated on the basis of information from a temperature sensor provided to the element 3 to be heated to realize fixing on the recording material by heating at appropriate temperatures.

Suppose that a printing device with the aforementioned fixing unit shown in FIG. 11 is placed in a relatively warm place in an environment of a temperature ranging from a room temperature to a temperature during summer, a recording material is placed in a well air-conditioned depository, and printing is started immediately after the recording material brought from the depository is put into the printing device. In this case, the environmental temperatures of the printing device are subjected to the correction for high temperature (temperature lowering correction) to lower a fixing temperature. Meanwhile, since the recording material gets cold sufficiently, fixing heat is not enough until the recording material adapts itself to the environmental temperatures, whereby the cold offset may occur. As a result, faulty fixing such as separation of toner may be generated.

In order for a fixing unit installed in a printing device to fix an unfixed toner image held on a recording material, the unfixed toner image may be fixed on the basis of the environmental temperatures of the printing device as shown in FIG. 11, or on the basis of the temperature of the fixing film 4 as disclosed in Japanese Patent Application Laid-open No. 2004-184621. In either case, it is not surely determined if the toner image on the recording material reaches a temperature at which fusing actually occurs. Accordingly, if a recording material holding a toner image of a temperature different from the environmental temperature of the device reaches the fixing unit, the temperature of the recording material holding the toner image may not fall within an allowable temperature range within which favorable fixing is realized. In this case, the cold offset may occur, causing fixing defects such as separation of toner.

SUMMARY OF THE INVENTION

It is an object of the present invention to at least partially solve the problems in the conventional technology.

According to the present invention, there is provided an electrophotographic printing device including: a fixing unit; and a temperature sensor, wherein the fixing unit including: a fixing member; a pressing member pressed against the fixing member; and a heater which heats at least the fixing member of the fixing member and the pressing member, the fixing unit fixing a toner image on a recording material to the recording material while carrying the recording material through a fixing nip formed between the fixing member and the pressing member, wherein the temperature sensor is attached to a recording material supplying unit, and detects a temperature of a recording material stored in the recording material supplying unit, and a fixing temperature is controlled based on the detected temperature.

According to another aspect of the present invention, there is provided an image forming apparatus including an electrophotographic printing device, the printing device including: a fixing unit; and a temperature sensor, wherein the fixing unit having: a fixing member; a pressing member pressed against the fixing member; and a heater which heats at least the fixing member of the fixing member and the pressing member, the fixing unit fixing a toner image on a recording material to the recording material while carrying the recording material through a fixing nip formed between the fixing member and the pressing member, wherein the temperature sensor is attached to a recording material supplying unit, and detects a temperature of a recording material stored in the recording material supplying unit, and a fixing temperature is controlled based on the detected temperature.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

A color printer M1 that is a printing device according to a first embodiment of the present invention will be described below.

Figure 1:
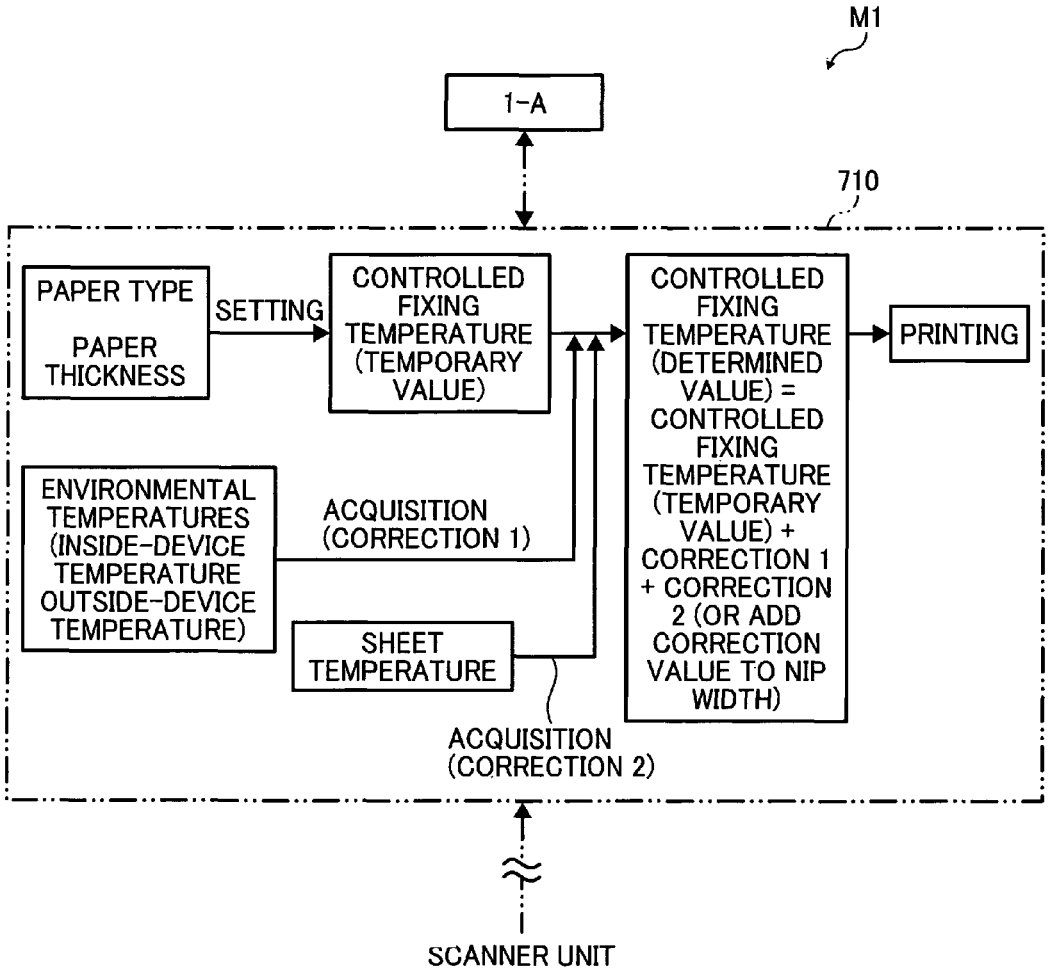
FIG. 1 is a functional block diagram of a fixing unit installed in a printing device according to an embodiment of the present invention.

FIG. 1 is a block diagram schematically showing the configuration of the color printer M1 according to the first embodiment. The color printer M1 and an operation panel 1-A with a display attached to the upper part of the color printer M1 have control units 710 and 720, respectively. The control units 710 and 720 are connected via a communication line through their communication ports, and transmit and receive a signal to and from each other. The control units 710 and 720 are also connected to a control unit (not shown) of a document scanning unit (scanner) as an image reader with an automatic document feeder (ADF, not shown) via a communication line through their communication ports, and transmit and receive a signal to and from each other.

As described above, the control unit 710 of the color printer M1 functions an image forming section (image forming unit) of the printer and/or controls a different printing operation unit, so that the printer can receive image data transmitted from a personal computer, a facsimile, or a scanner unit of a different image forming apparatus not shown, read the gradation data of each color in response to the received image data, and form an image in response to the read gradation data.

Figure 2:
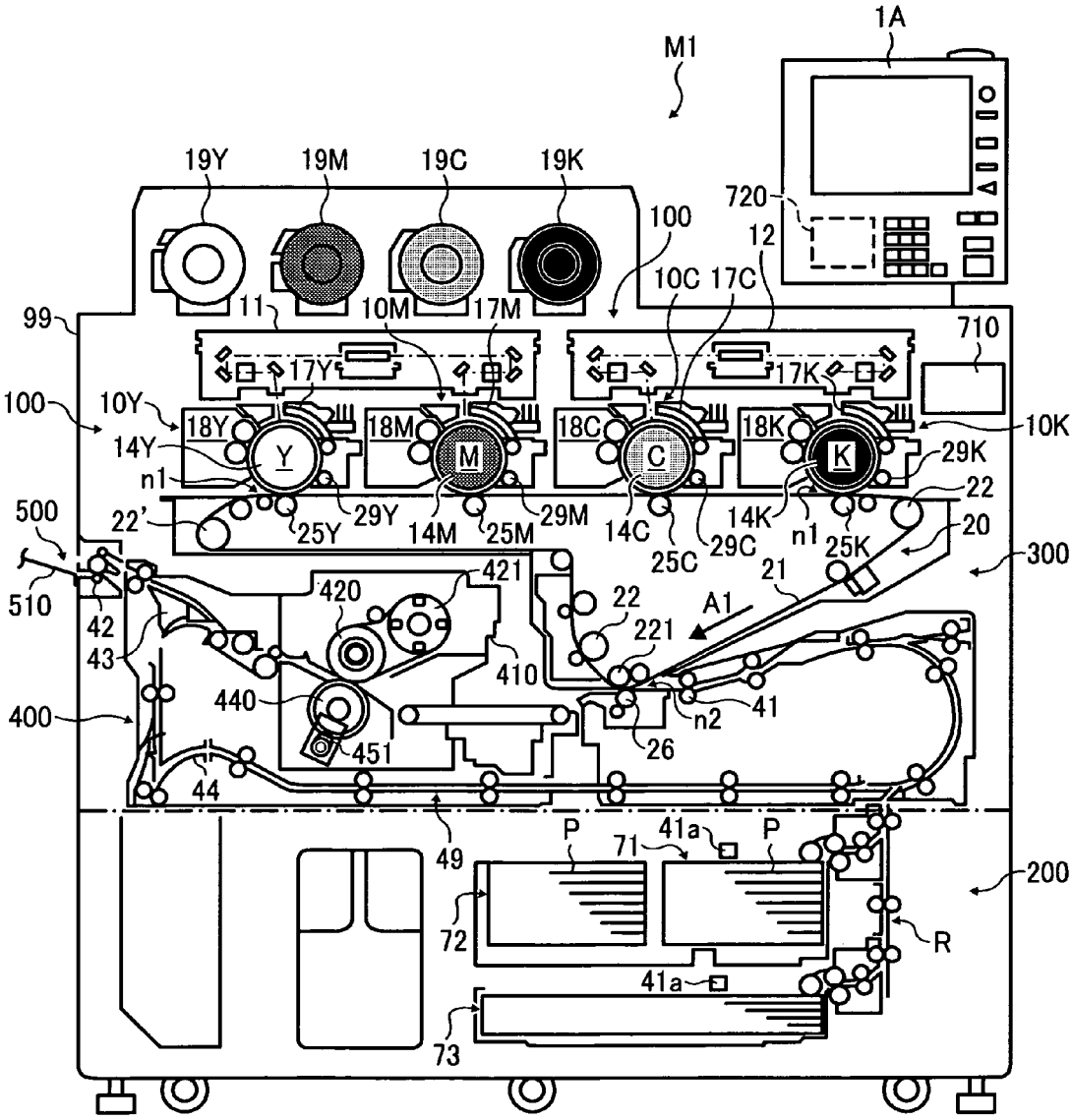
FIG. 2 is a diagram illustrating the overall configuration of the printing device shown in FIG. 1.

As shown in FIG. 2, a device body 99 of the color printer M1 includes: an image forming section (image forming unit) 100 for forming an image in response to the gradation data of each color; a recording material supplying unit 200 for supplying a recording material P as a recording material; a recording material feeding unit 300 extending from the recording material supplying unit 200 and through which a recording material P is carried; a fixing unit 400 interposed in a feed path R; an ejecting unit 500 provided at the downstream end of the feed path R; and the operation panel 1-A with a display.

The image forming section (image forming unit) 100 of the color printer M1 divides color image information received by the control unit 710 into colors including yellow Y, magenta M, cyan C, and black K, generates the data of the corresponding color plates in response to the resultant colors, and transmits the resultant data to exposure units (optical units) 11 and 12 for respective image forming units of the colors.

Image forming units 10Y (yellow), 10M (magenta), 10C (cyan), and 10K (black) corresponding to the four colors are supported in their predetermined aligned positions, and can be attached to and detached from the image forming section (image forming unit) 100 of the color printer M1.

The exposure units (optical units) 11 and 12 each provided for two colors are disposed to face the image forming units 10Y to 10K corresponding to the four colors, in positions above the image forming units 10Y to 10K. The exposure units (optical units) 11 and 12 are used for exposure, and which can emit a laser beam in response to the data of each color plate transmitted from the control unit 710. Toner bottles 19Y, 19M, 19C and 19K protruding from the upper part of the device body 99 are placed above the exposure units (optical units) 11 and 12. The toner bottles 19Y, 19M, 19C and 19K supply new toners to the image forming units 10Y, 10M, 10C and 10K corresponding to the four colors, respectively. The toner bottles 19Y, 19M, 19C and 19K are caused to rotate to feed toners through their pipes to developing units 18Y, 18M, 18C and 18K, respectively.

An intermediate transfer unit 20 is disposed below the image forming units 10Y to 10K corresponding to the four colors, in such a way that the intermediate transfer unit 20 faces the image forming units 10Y to 10K. The optical units 11 and 12 may be replaced by a single optical unit that can be responsive to the data of four color plates. Furthermore, the optical units 11 and 12 may not necessarily be of a laser system, but may be of a different system such as an LED system.

The image forming section (image forming unit) 100 includes the image forming units 10Y (yellow), 10M (magenta), 100 (cyan) and 10K (black) corresponding to the four colors that are disposed in the central portion of the device body 99. An intermediate transfer belt 21 of the intermediate transfer unit 20 is disposed below the image forming units 10Y to 10K. The image forming units 10Y to 10K arranged in series along a direction A1 in which the intermediate transfer belt 21 circulates form tandem arrangement.

The intermediate transfer unit 20 includes: the intermediate transfer belt 21 as a first intermediate transfer body; a plurality of suspension rollers 22 for rotatably supporting the intermediate transfer belt 21 while keeping the intermediate transfer belt 21 in the form of a loop; primary transfer rollers 25Y to 25K for transferring toner images formed on respective photosensitive elements 14Y to 14K onto the intermediate transfer belt 21; and a secondary transfer roller 26 for transferring the toner images formed on the intermediate transfer belt 21 onto a recording material P.

In a region rearward of the intermediate transfer belt 21 in FIG. 2, the primary transfer rollers 25Y to 25K are pivotally supported that face the photosensitive elements 14Y to 14K (that are supported by the device body 99) through their primary transfer positions, respectively.

As shown in FIG. 2, the photosensitive elements 14Y to 14K are driven to rotate in the counterclockwise direction in FIG. 2 by a driving motor (not shown). The photosensitive elements 14Y to 14K are subjected to a charging process at the positions of charging units 17Y to 17K, respectively. In this charging process, surfaces of the photosensitive elements 14Y to 14K are uniformly charged. The photosensitive elements 14Y to 14K are next subjected to an exposure process in which the photosensitive elements 14Y to 14K are exposed and scanned with the laser beam emitted from the exposure units 11 and 12 to form electrostatic latent images corresponding to the four colors.

Next, the surfaces of the photosensitive elements 14Y to 14K are subjected to a developing process in which the electrostatic latent images are developed by the developing units 18Y, 18M, 18C and 18K to form toner images corresponding to the four colors. The next process is a primary transfer process in which the toner images on the photosensitive elements 14Y to 14K are transferred onto the intermediate transfer belt 21 at respective positions between the intermediate transfer belt 21 and the primary transfer rollers 25Y to 25K.

In the next cleaning process, cleaning units 29Y to 29K collect untransferred toners left on the surfaces of the photosensitive elements 14Y to 14K with a cleaning blade, respectively, and bring the collected toners to a collector unit (not shown). A neutralization unit (not shown) thereafter removes residual potentials from the surfaces of the photosensitive elements 14Y to 14K.

Then, a series of the image forming processes performed on the photosensitive elements 14Y to 14K is completed. The toner images of the respective colors formed on the photosensitive elements 14Y to 14K as a result of the aforementioned developing process are transferred one above the other on the intermediate transfer belt 21 to form a color image on the intermediate transfer belt 21.

In the intermediate transfer unit 20, the intermediate transfer belt 21 is laid across and supported by the four primary transfer rollers 25Y to 25K as primary transfer rollers, and the plurality of suspension rollers 22, while being driven to run endlessly in the direction of the arrow A1 shown in FIG. 2 by the rotation of a driving roller 22'.

The four primary transfer rollers 25Y to 25K form respective primary transfer nips n1 by sandwiching the intermediate transfer belt 21 between them and the photosensitive elements 14Y to 14K, respectively. Further, a high voltage (transferring bias) opposite in polarity to toners is applied to the primary transfer rollers 25Y to 25K.

The intermediate transfer belt 21 runs in the clockwise direction A1 shown in FIG. 2 to sequentially pass through the primary transfer nips n1 of the primary transfer rollers 25Y to 25K. As a result, the toner images of the respective colors on the photosensitive elements 14Y to 14K are superimposed on one another, and primarily transferred onto the intermediate transfer belt 21.

The intermediate transfer belt 21 on which the toner images of the respective colors are transferred one above the other reaches a position facing a tension roller 221. The tension roller 221 forms a secondary transfer nip n2 at this position by sandwiching the intermediate transfer belt 21 between it and the secondary transfer roller 26. A high voltage (secondary transferring bias) opposite in polarity to toners is applied to the secondary transfer roller 26. This results in a secondary transfer process in which the four-color toner image formed on the intermediate transfer belt 21 is transferred onto a recording material P having reached the position of the secondary transfer nip n2. The intermediate transfer belt 21 having reached the position of an intermediate transfer cleaning unit (not shown) is subjected to removal of untransferred toner left on the intermediate transfer belt 21.

Then, a series of the transferring processes performed on the intermediate transfer belt 21 is completed.

In order to carry a recording material P from a pair of registration rollers 41 to the secondary transfer nip n2 formed between the tension roller 221 and the secondary transfer roller 26 facing the intermediate transfer belt 21 wound over the tension roller 221, the recording material P is stopped temporarily at the position of the pair of registration rollers 41 that has stopped its rotation. Then, the pair of registration rollers 41 is caused to rotate in sync with the transfer of a color image on the intermediate transfer belt 21 to carry the recording material P toward the secondary transfer nip n2. As a result, a desirable color image is transferred at once onto the recording material P.

The recording material P onto which the color image has been transferred at the position of the secondary transfer nip n2 is carried to the fixing unit 400.

A fixing roller 420 as a fixing member and a pressing roller 440 as a pressing member that constitute the fixing unit 400 apply heat and pressure, so that a four-color toner image is fixed as a permanent image on a surface of the recording material P.

The fixing unit 400 and a process conducted by the fixing unit 400 will be described in detail later. The recording material P is thereafter carried to the ejecting unit 500. The ejecting unit 500 includes a plurality of pairs of ejecting rollers 42 provided at the downstream end of a feed path, and a discharge tray 510, and is driven to discharge a recording material P carried from the fixing unit 400 to the outside of the device. Recording materials P delivered from the pairs of ejecting rollers 42 to the discharge tray 510 provided outside the device are sequentially stacked on the discharge tray 510.

The recording material supplying unit 200 provided at the lower part of the device body 99 shown in FIG. 2 is described next.

Figure 3:
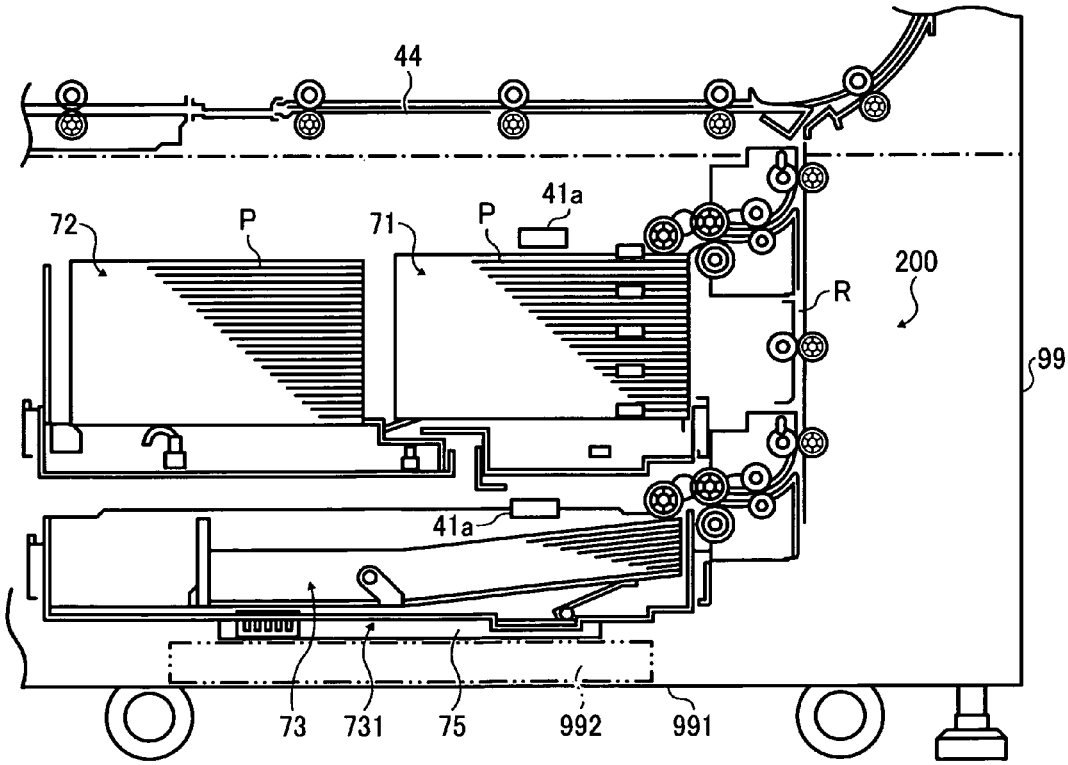
FIG. 3 is a diagram for explaining a heat amount necessary for front and rear surfaces of recording materials in a recording material supplying unit of the printing device shown in FIG. 1.

As shown in FIG. 3, the recording material supplying unit 200 includes a plurality of upper and lower paper cassettes 71 to 73, or a bypass paper tray not shown. Ordinary paper, thick paper, thin paper, OHP film sheets and others as recording materials P of various types are placed in each of the paper cassettes 71 to 73.

The right and left paper cassettes 71 and 72 as a pair hold ordinary paper consumed in large quantities. The paper cassettes 71 and 72 are vertically movable so that, when recording materials P in a bundle on the right side of FIG. 3 in a place facing the feed path R are used, the bottom plate of the right cassette forms the same plane as the bottom plate of the left cassette so that recording materials P in a bundle on the left side can be moved to the right side.

The feed path R extends upward from the right and lower paper cassettes 71 and 73 toward the recording material feeding unit 300.

In response to input of a printing start signal, the control unit 710 selects a suitable recording material P satisfying the condition of the input from recording materials P placed in the paper cassettes 71 to 73 in the recording material supplying unit 200. The selected recording material P is carried to the recording material feeding unit 300.

As shown in FIG. 3, temperature sensors 41*a* are attached to the paper cassettes 71 and 73 that determine the respective temperatures of the uppermost ones of recording materials P placed in the paper cassettes 71 and 73. Recording materials P in a bundle placed in the left cassette 72 are on standby, and are not used directly therefrom. Accordingly, the temperature sensor 41*a* is not provided to the paper cassette 72. The same sensors are used as the temperature sensors 41*a* that may, for example, be a non-contact sensor using a detecting element of a thermopile infrared sensor. The temperature sensors 41*a* can give detection signals of temperatures of recording materials in the paper cassettes 71 and 73 to the control unit 710. The temperature sensors 41*a* have a relatively wide range of measurable distances. Those to be employed as the temperature sensors 41*a* are such that the respective dimensions in the directions of the depths of the paper cassettes 71 and 73 fall within allowable detection ranges of the corresponding temperature sensors 41*a*. These non-contact temperature sensors 41*a* generally do not contact a recording material during a printing process, and accordingly, are advantageously employed as they do not damage an image or a recording material itself.

Figure 4:
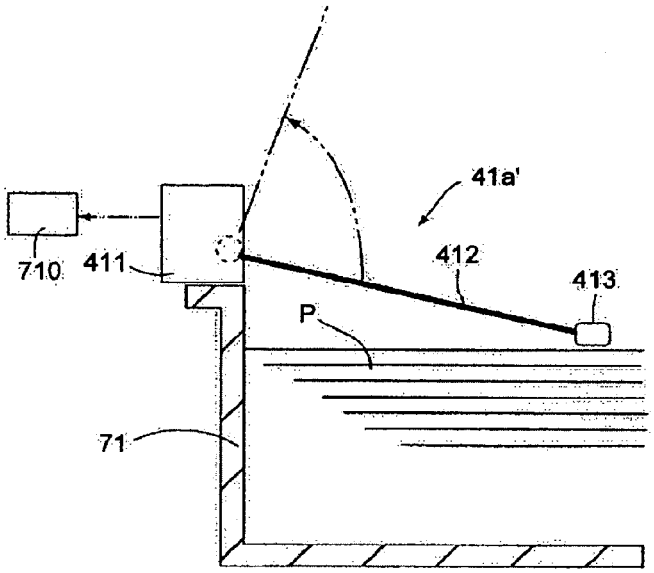
FIG. 4 is a diagram for explaining a main part of a temperature sensor of a different example used in the printing device shown in FIG. 1.

A contact temperature sensor 41*a*' may be used depending on the situation. The temperature sensor 41*a*' includes a body 411 fixedly attached to the upper end of a side wall of the paper cassette 71 or 73, a lever 412 extending from the body 411 and which is urged downward by a spring (not shown), and a detecting part 413 provided at the swinging end of the lever 412 as shown in FIG. 4. A detection signal from the detecting part 413 is given to the control unit 710.

The paper cassette 73 at the lowest part out of the paper cassettes 71 to 73 has a bottom wall 731 of the body the lower surface of which faces a bottom wall 991 of the device body 99. A heater 75 of a recording material supplying unit is supported through a supporting member 992 on the bottom wall 991. The heater 75 of a recording material supplying unit is connected through a heater driving circuit to the control unit 710. The heater 75 of a recording material supplying unit is required to be function as a heat source. The system and the location of the heater 75 are suitably determined.

A recording material P is suitably selected from the recording material supplying unit 200 by the control unit 710, and the selected recording material P is carried to a plurality of paper feeding rollers arranged along the feed path R. The upper part of the feed path R reaches the recording material feeding unit 300. A recording material P is stopped temporarily at the pair of rollers 41, and is sent at an appropriate time to a secondary transfer position.

As shown in FIG. 2, a duplex unit 49 is provided in the recording material feeding unit 300. The duplex unit 49 causes a recording material P to switchback at the pair of ejecting rollers 42 during duplex printing, and carries the recording material P with a switching claw 43 to a feed path 44 in the duplex unit 49. Here, the recording material P is carried by a plurality of pairs of carriage rollers toward the pair of registration rollers 41.

The recording material P heading for the pair of registration rollers 41 is caused to move as shown in FIG. 2 in response to the operation of the pair of registration rollers 41 made at a certain time for carrying the recording material P to the secondary transfer position n2. Then, a full-color image is transferred to the recording material P, and the recording material P thereafter reaches the fixing unit 400 interposed in the feed path R at the rear side.

The fixing unit 400 installed in an image forming apparatus responsible for a series of the aforementioned image forming processes will be described in detail below.

Figure 5:
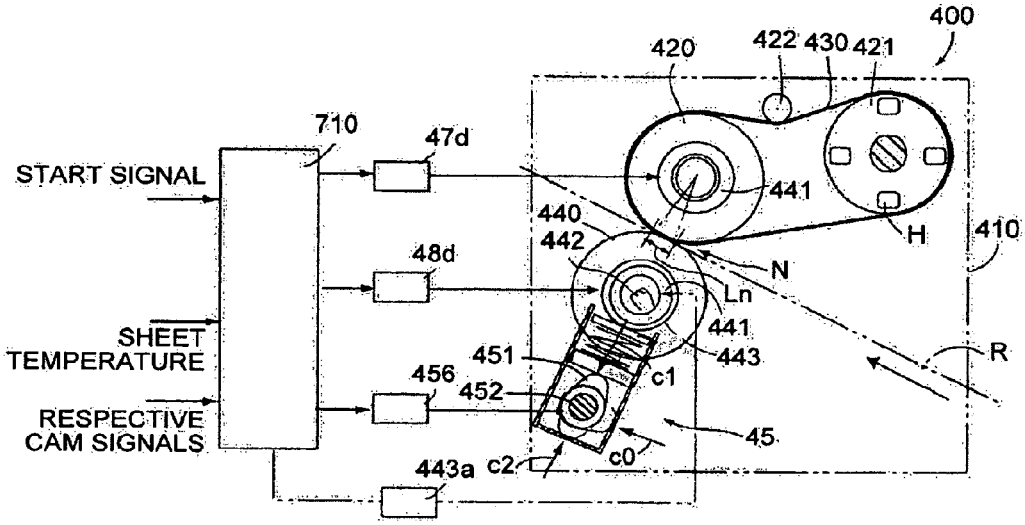
FIG. 5 is an enlarged explanatory view of a fixing unit provided to the printing device shown in FIG. 1.
Figure 6:
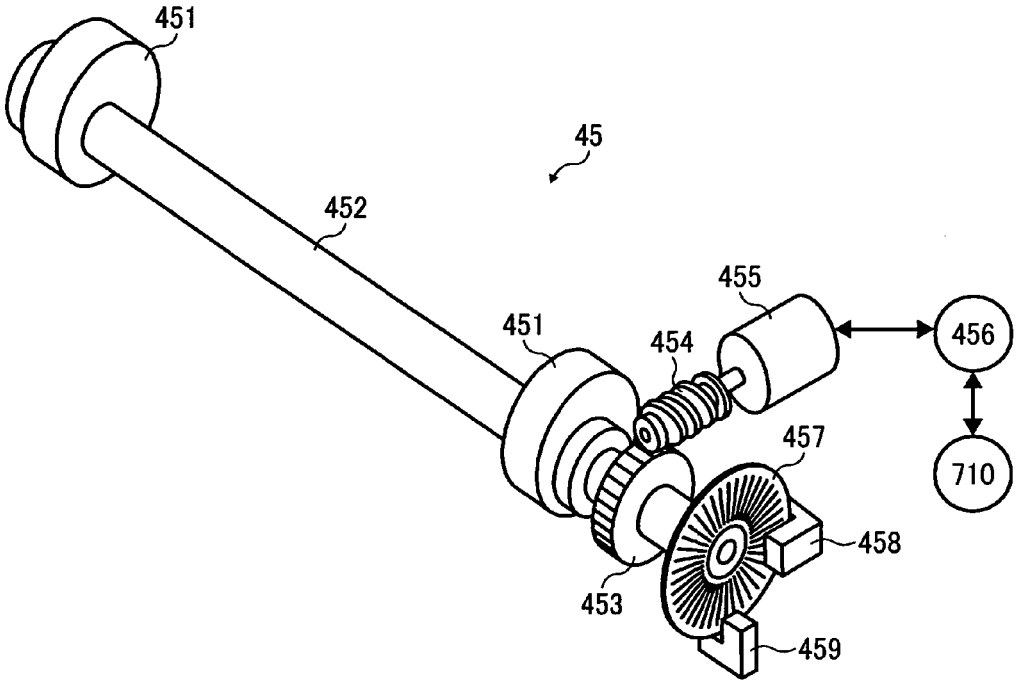
FIG. 6 is an enlarged perspective view of a lifting unit provided to the fixing unit shown in FIG. 5.

As shown in FIGS. 5 and 6, the fixing unit 400 includes the fixing roller 420, a heating roller 421, an endless belt 430 wound over the fixing roller 420 and the heating roller 421, and the pressing roller 440 being in contact under pressure with the fixing roller 420 over which the endless belt 430 is wound. These components are provided inside a body 410. The fixing roller 420 and the pressing roller 440 are driven by driving units 47*d* and 48*d*, respectively. The driving units 47*d* and 48*d* are driven by the control unit 710 such that the driving units 47*d* and 48*d* cause the fixing roller 420 and the pressing roller 440, respectively, to rotate at appropriate times. Reference numeral 422 indicates an idler that holds the endless belt 430 under desirable tension. This idler may also function as a coating unit of a mold releasing agent. The heating roller 421 has a plurality of dispersed heat sources H thereinside for heating the endless belt 430.

The pressing roller 440 has a heater 442 placed in a hollow metal tube 441. The heater 442 is connected through a heater driving circuit 443*a* to the control unit 710. The pressing roller 440 further includes bulging rings 443 in the form of bearings at the right and left ends that expand out from the outer peripheral surface of the hollow metal tube 441. Lift cams 451 of a lifting unit 45 shown in FIG. 6 contact the outer faces of the bulging rings 443.

The right and left lift cams 451 are formed integrally with a lift shaft 452. The lift shaft 452 is coupled to a motor 455 through a speed reducer with a worm gear 453 and a worm 454 engaged with the worm gear 453 that are provided at one end of the lift shaft 452. The motor 455 is connected to the control unit 710 through a motor driving circuit 456.

A rotation angle detecting rotor 457 is formed integrally with an end portion of the lift shaft 452. The rotation angle detecting rotor 457 has a plurality of angle detecting sensors 458 and 459 that are opposite each other. A large number of small holes h are defined in a circle per unit angle in the rotation angle detecting rotor 457. The control unit 710 causes the angle detecting sensors 458 and 459 composed of photocouplers to detect intermittent signals of light passing through the small holes h. The control unit 710 also causes the angle detecting sensors 458 and 459 to detect an on-off signal of light intermittently passing through a reference hole indicating the position of a reference cam angle. The control unit 710 can determine the current rotation angle of the pair of lift cams 451 on the lift shaft 452 in response to these signals.

Figure 7:
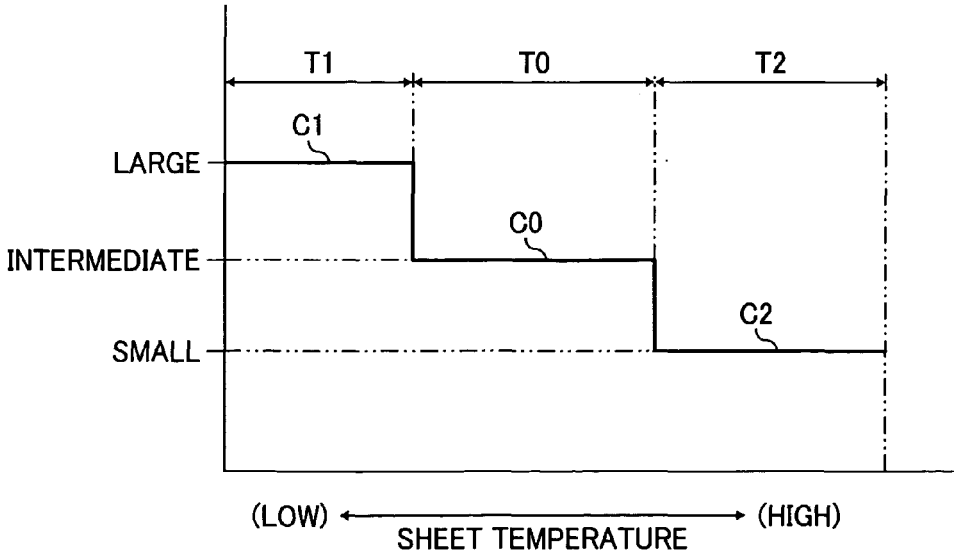
FIG. 7 is a diagram showing control characteristics of a lift cam used for control of the fixing unit shown in FIG. 5.

As shown in FIGS. 5 and 7, the rotation angle of the lift cams 451 changes among a stationary intermediate angle position c0 that is a reference position of the lift cams 451, a pressing position c1 at which the amount of lift of the lift cams 451 becomes maximum, and a retracted position c2 at which the amount of lift of the lift cams 451 becomes minimum.

The intermediate angle position c0 during stationary time T0 is selected when the ambient temperature of the device is within an allowable stationary range. A fixing nip N formed at the intermediate angle position c0 between the fixing roller 420 and the pressing roller 440 has a nip width Ln (see FIG. 5) set at a value that allows appropriate heating and fixing during normal time.

The pressing position c1 at which the amount of lift becomes maximum is selected in a time T1, for example, in winter when an ambient temperature is excessively low. The nip width Ln of the fixing nip N formed between the fixing roller 420 and the pressing roller 440 at the pressing position c1 is greater than that of normal time to obtain a necessary amount of heat. At this time, the nip width Ln is set at a value that can prevent the occurrence of cold offset.

The retracted position c2 at which the amount of lift becomes minimum is selected in a time T2, for example, in summer when an ambient temperature is excessively high. The nip width Ln of the fixing nip N formed between the fixing roller 420 and the pressing roller 440 at the retracted position c2 is smaller than that of normal time to suppress overheating. At this time, the nip width Ln is set at a value that prevents the occurrence of hot offset due to fixing by excessive heating. The diagram of FIG. 7 shows the aforementioned switching characteristics of the lift cams.

The operation of the color printer M1 responsible for the aforementioned series of the image forming processes is described next by explaining the printing control function of a control unit.

First, an image to be printed is selected on the display of the operation panel 1-A. Then, setting information about formation of a plurality of images is entered, and a start switch is turned on.

In response, the control unit 710 of the color printer M1 causes the image forming section (image forming unit) 100 to form an image in response to the gradation data of each color. The control unit 710 also causes the recording material supplying unit 200 to start supply of a selected recording material P, and causes the fixing unit 400 in standby interposed in the feed path R to start fixing.

In the image forming section (image forming unit) 100 of the color printer M1, on the basis of information about a color image received by the control unit 710 and a image forming mode, the image forming units 10Y, 10M, 10C and 10K perform image forming processes in a full-color mode to form toner images of the respective colors. The toner images thereby formed are sequentially superimposed on the previously formed toner images, and then carried to the secondary transfer position.

At the same time, a recording material P selected from the paper cassettes 71 to 73 at the lower part of the image forming unit 100 reaches the pair of registration rollers 41 at which the selected recording material P is subjected to skew correction. Then, the superimposed image is secondarily transferred at a predetermined time onto the recording material P at the secondary transfer position n2 by the pair of registration rollers 41. The recording material P is thereafter carried to the fixing unit 400.

Figure 8:
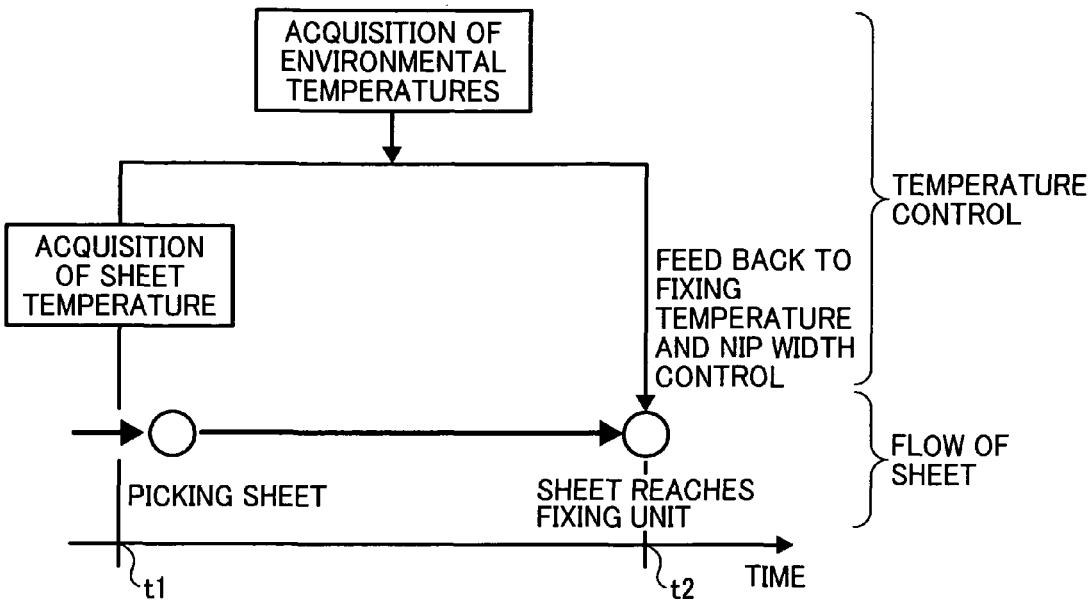
FIG. 8 is a block diagram for explaining temporal characteristics of temperature control in the fixing unit shown in FIG. 5.
Figure 9:
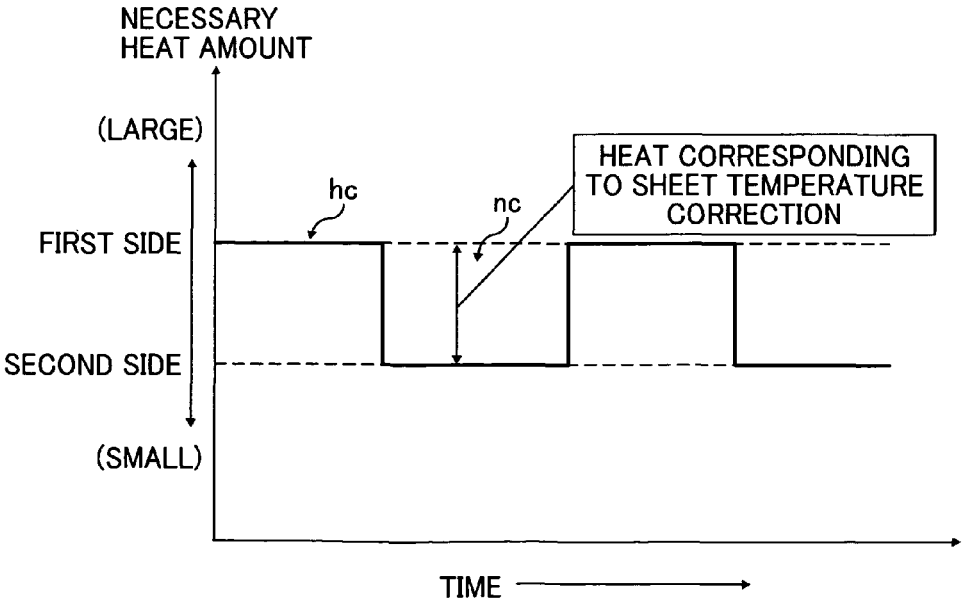
FIG. 9 is a block diagram for explaining temporal characteristic of temperature control in the fixing unit shown in FIG. 5 during duplex printing.

At the point in time t1 shown in FIG. 8, the control unit 710 specifies the paper cassette 71, 72 or 73, reads the temperature of recording materials stacked in the specified cassette and the environmental temperatures (ambient temperatures), and drives the heater of the fixing unit 400 to perform heating in a heating mode that is responsive to the recording material temperature.

The recording material temperature thereby read is used for control of the fixing temperature of a recording material P to be picked after the latest recording material reaches the fixing unit 400. The reason therefor is that, in consideration of time elapsed during carriage through the feed path R, it is reasonable to determine the temperature of a recording material P to be picked after a preceding recording material reaches the fixing unit 400 at the time of the determination of the recording material temperature. The control unit 710 finds the latest appropriate fixing temperature (target temperature) on the basis of the detected recording material temperature and the detected environmental temperature (of a narrow range of variation that is free from a problem relating to responsiveness). Then, the control unit 710 controls the operations of the heater 442 of the pressing roller 440 and the heat sources H of the heating roller 421 such that the found temperature is maintained. The control unit 710 also controls the nip width Ln (defined by the fixing roller 420 and the pressing roller 440) at an appropriate value through the lift cams 451 of the lifting unit 45. The controlled nip width Ln can be fed back to a target value, thereby stabilizing control.

As shown in FIG. 7, an appropriate value (target value) of the nip width Ln defined by the fixing roller 420 and the pressing roller 440 is such that it keeps the nip width Ln at a width during normal time by placing the rotation angle of the lift cams 451 at the intermediate angle position c0 when an environmental temperature (ambient temperature) is at a level of the stationary time T0. During the time T1 when an ambient temperature is excessively low, the nip width Ln is made greater than that of the normal time by placing the rotation angle of the lift cams 451 at the pressing position c1 to obtain a necessary amount of heat. During the time T2 when an ambient temperature is excessively high, the nip width Ln is made smaller than that of the normal time by placing the rotation angle of the lift cams 451 at the retracted position c2. Further, the fixing roller 420 and the pressing roller 440 are driven to rotate through the driving units 47*d* and 48*d*, respectively, to suppress heating of a recording material P.

Along with the aforementioned temperature adjustment made by the fixing unit 400, the control unit 710 controls the paper cassettes 72 and 73 such that temperature adjustment of a recording material is realized at an early stage at the paper cassettes 72 and 73.

The control unit 710 determines a recording material temperature. If a recording material P has not been in place for a long time but has just been brought in from a low-temperature environment, a recording material temperature changes with time until the recording material P adapts itself to an environmental temperature (until the recording material temperature gets closer to the environmental temperature). In this case, a difference between the recording material temperature and the environmental temperature is calculated. If the calculated difference in temperature is large, the heater 75 of a recording material supplying unit disposed in the recording material supplying unit 200 shown in FIG. 3 is used to heat the recording material P along with the feedback control of a fixing temperature (the point in time t2 shown in FIG. 8), thereby stabilizing control in a short period of time and reliably maintaining responsiveness.

Recording materials P in the paper cassettes 72 and 73 get closer in temperature to an ambient temperature with time after being placed in the device. Suppose, for example, that a recording material P stored in a depository in a low temperature is placed in the paper cassette 73, and the recording material P considerably lower in temperature than the temperature of the device is to be used immediately thereafter. In this case, there is a large difference between the ambient temperature and the recording material temperature, so that toner may fail to reach a fusing temperature even after the control operation of the control unit 710 for operating the fixing unit 400 in response to the ambient temperature of the device. Such fixing control may generate separation of the toner. In response to this problem, in order to stabilize fixing control in a short period of time, the control unit 710 causes the heater 75 of a recording material supplying unit to directly heat a recording material P placed in the paper cassette 73, so that the recording material P gets closer in temperature to an ambient temperature at an early stage.

As described above, the color printer M1 has a function capable of controlling fixing while maintaining an appropriate fixing temperature determined in consideration of a recording material temperature.

The amount of heat to be supplied is continuously increased or decreased in response to the temperature of a recording material P. At the same time, if there is a large difference between an ambient temperature and a recording material temperature, the heater 75 of a recording material supplying unit heats a recording material P placed in the paper cassette 73. Accordingly, the recording material supplying unit 200 acquires a recording material temperature, and the acquired recording material temperature is fed back to a fixing temperature. As a result, a fixing temperature can be controlled appropriately to reliably maintain stable fixing property. In particular, even if a recording material temperature differs largely from an ambient temperature, the fixing property of a permanent toner image on a printed output of the color printer M1 is enhanced and stabilized at an early stage.

The recording material supplying unit 200 acquires a recording material temperature, and the acquired recording material temperature is fed back to the nip width Ln to control the nip width Ln. Thus, fixing property is enhanced and stabilized at an early stage.

If the recording material supplying unit 200 includes the plurality of recording material supplying units 200, the recording material supplying units 200 acquire respective recording material temperatures, and the acquired recording material temperatures are fed back to control of a fixing temperature and a nip width. Thus, stable fixing property can be reliably maintained.

As described, the recording material supplying unit 200 acquires a recording material temperature, and the acquired recording material temperature is fed back to control of a fixing temperature and a nip width. The recording material supplying unit 200 also acquires an environmental temperature. This realizes feedback control in consideration of the acquired environmental temperature to maintain control of an appropriate fixing temperature and a nip width.

The control unit 710 of the color printer M1 shown in FIG. 1 feeds the temperature of a recording material P to be picked next back to control of an appropriate fixing temperature and a nip width, thereby stabilizing control.

In particular, when a printing process of a first side and a printing process of a second side (rear surface) are alternately performed during printing in a duplex printing mode, a recording material temperature is made to get closer to an ambient temperature on the first side. This process is performed in a region (region hc to which a necessary amount of heat is to be added) to which heat corresponding to temperature correction is to be applied for raising a temperature from that during normal time. Accordingly, the operations of the heater 442 and the heat sources H in the fixing unit 400 are suppressed during subsequent printing of the second side (rear surface) to maintain a roller temperature at a stationary temperature. Heating control is switched to a region nc in a general heating state to prevent unnecessary heating.

The non-contact temperature sensors 41*a* of the recording material supplying unit 200 for acquiring a recording material temperature acquire a temperature without damaging a recording material, so that stable fixing property can be reliably maintained.

Further, if a recording material temperature is lower than an ambient temperature, the heat source provided in the recording material supplying unit 200 raises the temperature of a recording material P. Thus, stable fixing property can be reliably maintained.

While the color printer M1 performs duplex printing, the temperature of a recording material is fed back to control of a fixing temperature and a nip width only in printing a first side. Accordingly, the recording material is already close in temperature to an environmental temperature at the time of printing of a second side, thereby eliminating unnecessary temperature adjustment of the second side.

Thus, it is possible to provide an image forming apparatus capable of controlling a fixing temperature appropriately in consideration of a recording material temperature.

The color printer M1 described above is capable of controlling a fixing temperature appropriately to stabilize fixing property even if there is a large difference between an environmental temperature and a recording material temperature. The color printer M1 may be replaced by an image forming apparatus composed of an MFP including the color printer M1. This image forming apparatus achieves the same effects as those of the color printer M1.

The present invention described above is not limited to the specific configurations of the embodiments above. Various configurations may be employed without departing from the scope of claims.

Figure 10:
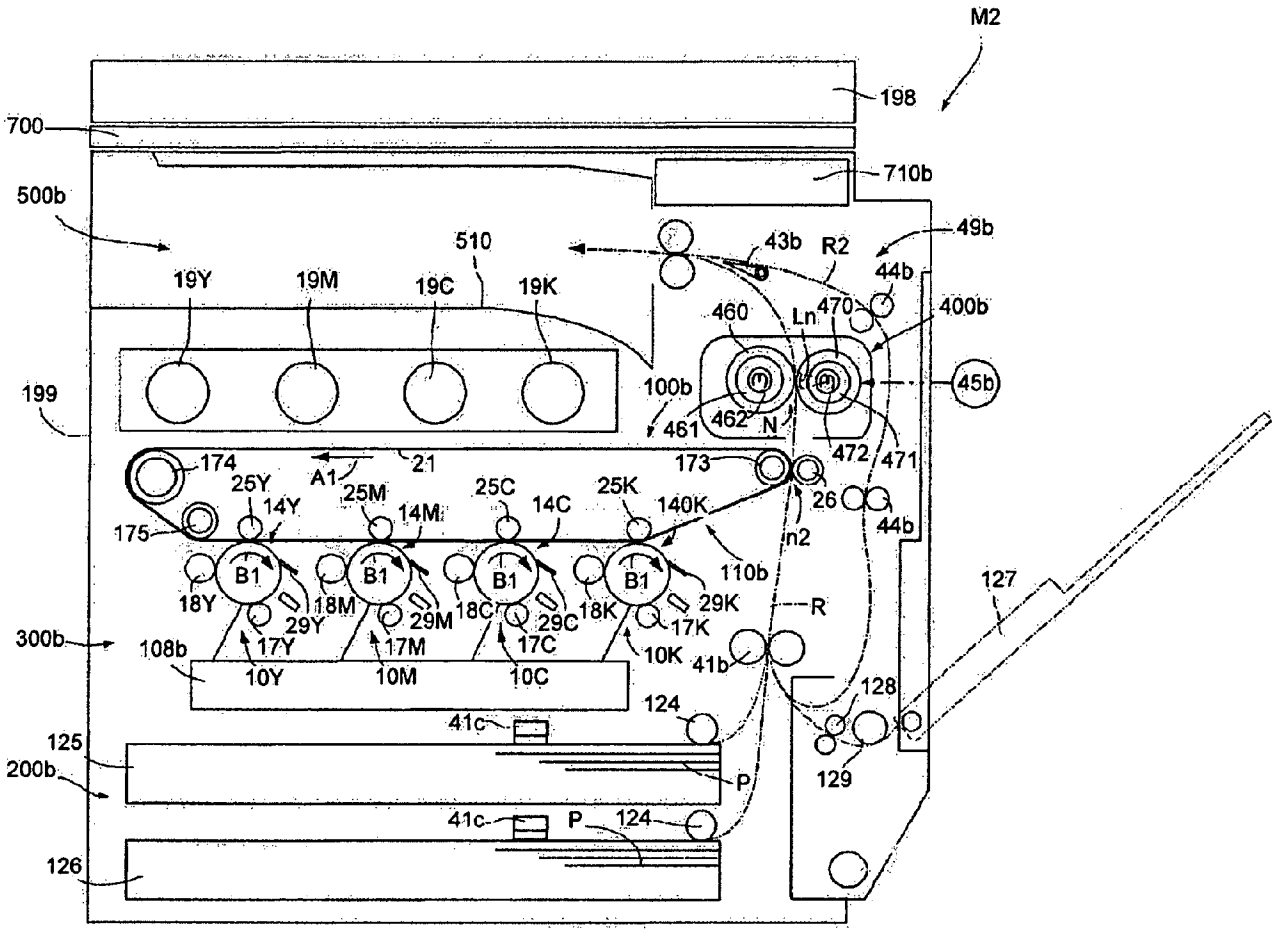
FIG. 10 is a schematic view illustrating a copying machine according to a second embodiment of the present invention.
Figure 11:
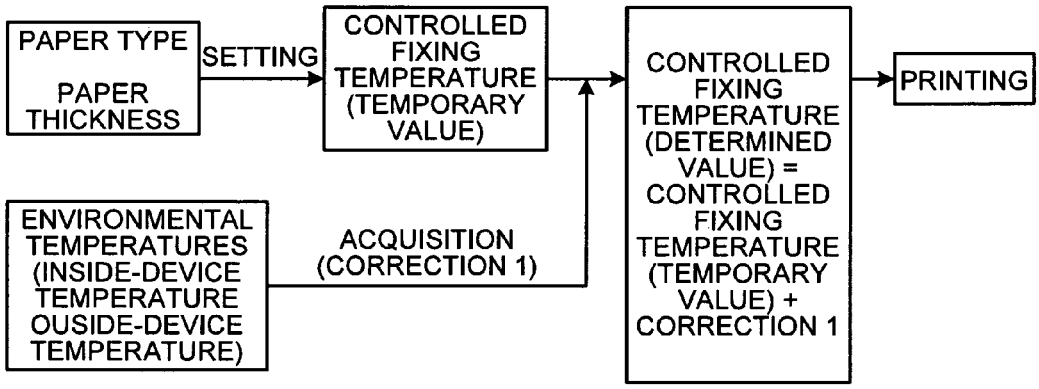
FIG. 11 a functional block diagram of a fixing unit installed in a conventional printing device.

While the color printer M1 is described in the first embodiment, the invention may be applied, for example, to a copying machine as an image forming apparatus such as that shown in FIG. 10 to constitute a second embodiment.

A color digital copying machine M2 (image forming apparatus) of the second embodiment includes: an image forming unit 100*b* for forming an image in response to the gradation data of each color; a recording material supplying unit 200*b* for carrying a recording material P; a recording material feeding unit 300*b* interposed in a feed path R extending from the recording material supplying unit 200*b*; a fixing unit 400*b*; and an ejecting unit 500*b* provided at the downstream end of the feed path R. These components are provided in a device body 199. The color digital copying machine M2 further includes an image processing system (IPS) 700 responsible for predetermined image processing on image data received from a personal computer or a facsimile (not shown), or from a scanner unit 198 provided above the image forming unit 100*b*. The color digital copying machine M2 also includes a control unit 710*b* for controlling the color digital copying machine M2 including the image processing system 700, the image forming unit 100*b*, the recording material supplying unit 200*b*, and the like.

In the color digital copying machine M2, color image information of a document read by and then transmitted from the scanner unit 198 and the like is divided by the image processing system (IPS) 700 into colors including yellow, magenta, cyan, and black. Then, the data of each color plate is generated, and the resultant data is transmitted to an exposure unit (optical unit) 108*b* for image forming units of the respective colors.

Image forming units 10Y (yellow), 10M (magenta), 100 (cyan), and 10K (black) corresponding to the four colors are supported in their predetermined positions, and can be attached to and detached from the image forming unit 100*b*.

An intermediate transfer unit 110*b* is disposed above the image forming units corresponding to the four colors, in such a way that the intermediate transfer unit 110*b* faces the image forming units. The exposure unit (optical unit) 108*b* is placed below the image forming units, in such a way that the exposure unit 108*b* faces the image forming units. The exposure unit 108*b* can emit a laser beam in response to the data of each color plate transmitted from the image processing system (IPS) 700. Toner bottles 19Y, 19M, 19C and 19K are placed above the intermediate transfer unit 110*b*. The toner bottles 19Y, 19M, 19C and 19K supply new toners to the image forming units 10Y, 10M, 10C and 10K, respectively, corresponding to the four colors. The toners are fed through their pipes (not shown) to developing units 18Y, 18M, 18C and 18K.

A plurality of paper cassettes 125 and 126 of the recording material supplying unit 200*b* is provided below the optical unit 108*b*. The feed path R extending from the paper cassettes 125 and 126 reaches a discharge tray 510 of the ejecting unit 500*b* after passing through a secondary transfer nip n2 on a lateral side of the intermediate transfer unit 110*b*, and the fixing unit 400*b*.

The configuration of the image forming unit 100*b* is defined by turning the configuration of the image forming unit 100 of the first embodiment upside down. For the sake of simplicity, the same components are designated by the same reference numerals.

The image forming units 10Y, 10M, 10C and 10K corresponding to the four colors are disposed in the central portion of the device body 199. An intermediate transfer belt 21 of the intermediate transfer unit 110*b* is disposed above the image forming units 10Y to 10K. The image forming units 10Y to 10K corresponding to the four colors form tandem arrangement.

The intermediate transfer unit 110*b* includes: three suspension rollers 173, 174 and 175 for rotatably supporting the intermediate transfer belt 21 while keeping the intermediate transfer belt 21 in the form of a loop; primary transfer rollers 25Y to 25K for transferring toner images formed on photosensitive elements 14Y to 14K respectively onto the intermediate transfer belt 21; and a secondary transfer roller 26 for transferring the toner images formed on the intermediate transfer belt 21 onto a recording material P.

The arrows A1 and B1 shown in FIG. 10 indicate a direction in which the intermediate transfer belt 21 runs, and a direction in which the photosensitive elements 14Y to 14K rotate, respectively.

Paper feeding rollers 124 for feeding a recording material P from the paper cassettes 125 and 126 or from a bypass paper tray 127 are provided. A pair of registration rollers 41*b* for carrying the recording material P thereby fed to the secondary transfer nip n2 is also provided.

A duplex unit 49*b* is provided in a projecting portion 991 on a lateral side of the device body 199. The duplex unit 49*b* causes a recording material P to switchback at a pair of ejecting rollers 42 during duplex printing. The duplex unit 49*b* thereafter carries the recording material P with a switching claw 43*b* to a feed path R2 in the duplex unit 49*b*, and then causes a pair of carriage rollers 44*b* to carry the recording material P toward the pair of registration rollers 41*b*. Reference numeral 129 indicates a feeding roller for bypass feeding, and reference numeral 128 indicates a pair of carriage rollers.

Like in the first embodiment, a full-color image forming process is also performed in the image forming units 10Y, 10M, 100 and 10K for Y, M, C and K to form the toner images of the respective colors. The toner images thereby formed are transferred while being sequentially superimposed on the previously formed toner images.

A recording material P fed from each paper cassette provided below the image forming unit 100*b* is subjected to skew correction at the pair of registration rollers 41*b*, and is thereafter carried at a predetermined time to the secondary transfer nip n2.

A secondary transferring bias of the same polarity as the charging polarity of toner is applied from a secondary transfer power supply (not shown) to the tension roller 173 at a position facing the secondary transfer nip n2. In contrast, the secondary transfer roller 26 being in contact with the front side of the belt is grounded. Thus, the four-color toner image formed on the front side of the intermediate transfer belt 21 enters the secondary transfer nip n2 as the intermediate transfer belt 21 runs, and which is then secondarily transferred onto a recording material P.

The materials of the intermediate transfer belt 21, the tension roller 173 and the secondary transfer roller 26 in the aforementioned configuration are the same as those of the intermediate transfer belt 21 used in the first embodiment, and are not described repeatedly.

The fixing unit 400*b* that is a fixing unit installed in the copying machine M2 of the second embodiment applies heat and pressure with a fixing roller 460 and a pressing roller 470 to an unfixed toner image on a guided recording material P after being subjected to a secondary transfer process.

Like the fixing roller 420 and the pressing roller 440 shown in FIG. 5, the fixing roller 460 and the pressing roller 470 also have heaters 462 and 472 placed in hollow metal tubes 461 and 471, respectively. The heaters 462 and 472 are connected through heater driving circuits (not shown) to the control unit 710*b*. The pressing roller 470 is provided with a lifting unit 45*b* that is the same as the lifting unit 45 of the first embodiment shown in FIG. 6. Thus, a nip width Ln (defined by the fixing roller 460 and the pressing roller 470) is controlled to an appropriate value (the same control characteristics as those shown in FIG. 7) by operating the lifting unit 45*b*, and the nip width Ln can be fed back to a target value, thereby stabilizing fixing property.

Like that in the first embodiment, non-contact temperature sensors 41*c* for detecting the respective temperatures of the uppermost ones of recording materials P are attached to the paper cassettes 125 and 126 of the recording material supplying unit 200*b* of the second embodiment. The temperature sensors 41*c* of the paper cassettes 125 and 126 are subjected to the same control as that in the first embodiment, and the temperatures of recording materials P in the paper cassettes 125 and 126 are transmitted to the control unit 710*b*.

The control unit 710*b* performs the same control as that of the first embodiment to switch a degree of contact of the pressing roller 470 with the fixing roller 460 in response to a recording material temperature, so that the nip width Ln (see FIG. 5) of the fixing nip N formed between these rollers is changed in the same way. As a result, fixing property is enhanced and stabilized at an early stage.

If the paper cassettes 125 and 126 include a plurality of paper cassettes 125 and 126, temperatures of recording materials P placed in the paper cassettes 125 and 126 are acquired. The acquired temperatures are fed back to control of a fixing temperature and a nip width, so that stable fixing property can be reliably maintained.

The structure of the image forming apparatus M2 shown in FIG. 10 may be employed in a different printing device or a facsimile, or to an image forming apparatus composed of a copying machine including a printing device and a facsimile. In either case, the same effect as that of the image forming apparatuses shown in FIGS. 2 and 10 is achieved.

The embodiment can provide an image forming apparatus that can control a fixing temperature appropriately in consideration of a recording material temperature. The image forming apparatus can control a fixing temperature appropriately even if there is a large difference between an environmental temperature and a recording material temperature, so that fixing property can be stabilized. In particular, the recording material supplying unit acquires a recording material temperature, and the acquired temperature is fed back to a fixing temperature, thereby controlling the fixing temperature. Thus, stable fixing property can be reliably maintained.

According to the embodiment, if the recording material supplying unit includes a plurality of recording material supplying units, recording material temperatures acquired in the corresponding recording material supplying units are fed back to control of the fixing temperature and a nip width. That is, each recording material supplying unit controls the fixing temperature and the nip width, thereby reliably maintaining stable fixing property.

According to the embodiment, the recording material supplying unit acquires a recording material temperature, and the acquired temperature is fed back to control of the fixing temperature and the nip width. The recording material supplying unit also acquires an environmental temperature, and the acquired environmental temperature is fed back to control of the fixing temperature and the nip width. Thus, stable fixing property can be reliably maintained.

According to the embodiment, the temperature of a recording material to be picked next is fed back to control of the fixing temperature and the nip width, so that stable fixing property can be reliably maintained.

According to the embodiment, a sensor for acquiring a recording material temperature in the recording material supplying unit is a non-contact sensor. Thus, the sensor acquires a temperature without damaging a recording material, so that stable fixing property can be reliably maintained.

According to the embodiment, if the temperature of a recording material is lower than the environmental temperature, a heat source provided in the recording material supplying unit raises the temperature of the recording material. Thus, stable fixing property with good responsiveness can be reliably maintained.

According to the embodiment, the recording material temperature is fed back to control of the fixing temperature and the nip width only in printing a first side during duplex printing. Thus, unnecessary heating can be suppressed.

Even if there is a large difference between the environmental temperature and the recording material temperature, the image forming apparatus of the embodiment can control the fixing temperature appropriately to stabilize fixing property. Accordingly, the image forming apparatus achieves the same effect as that of the printing device as recited in the embodiment.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electrophotographic printing device comprising:
a fixing unit; and
a temperature sensor,
wherein the fixing unit includes
a fixing member;
a pressing member pressed against the fixing member; and
a heater configured to heat at least the fixing member of the fixing unit and the pressing member, the fixing unit configured to fix a toner image on a recording material to the recording material while carrying the recording material through a fixing nip formed between the fixing member and the pressing member,
wherein the temperature sensor is attached to a recording material supplying unit, and is configured to detect a temperature of a recording material stored in the recording material supplying unit, and a fixing temperature is controlled based on the detected temperature, and
wherein the recording material supplying unit is configured to include a heat source, and if there is a large difference between an environmental temperature of the printing device and the temperature of the recording material in the recording material supplying unit, the heat source heats the recording material.

2. The printing device according to claim 1, wherein a nip width of the fixing nip is controlled based on the detected temperature.

3. The printing device according to claim 1, wherein:
the recording material supplying unit includes a plurality of recording material supplying units;
the temperature sensor is attached to each of the recording material supplying units; and
the fixing temperature and a nip width are controlled based on the temperature of the recording material detected by the temperature sensor attached to the recording material supplying unit that feeds a recording material for printing of the recording material supplying units.

4. The printing device according to claim 1, wherein the fixing temperature and a nip width are controlled based on an environmental temperature of the printing device in addition to the detected temperature.

5. The printing device according to claim 1, wherein the temperature sensor detects a temperature of a recording material to be picked next as the temperature of the recording material stored in the recording material supplying unit.

6. The printing device according to claim 1, wherein the temperature sensor is a non-contact sensor.

7. An image forming apparatus comprising an electrophotographic printing device, the printing device including:
a fixing unit; and
a temperature sensor,
wherein the fixing unit includes
a fixing member;
a pressing member pressed against the fixing member; and
a heater configured to heat at least the fixing member of the fixing unit and the pressing member, the fixing unit configured to fix a toner image on a recording material to the recording material while carrying the recording material through a fixing nip formed between the fixing member and the pressing member,
wherein the temperature sensor is attached to a recording material supplying unit, and is configured to detect a temperature of a recording material stored in the recording material supplying unit, and a fixing temperature is controlled based on the detected temperature, and
wherein the recording material supplying unit is configured to include a heat source, and if there is a large difference between an environmental temperature of the printing device and the temperature of the recording material in the recording material supplying unit, the heat source heats the recording material.

8. An electrophotographic printing device comprising:
a fixing unit; and a temperature sensor, wherein the fixing unit includes a fixing member;

a pressing member pressed against the fixing member; and a heater configure to heat at least the fixing member of the fixing unit and the pressing member, the fixing unit configured to fix a toner image on a recording material to the recording material while carrying the recording material through a fixing nip formed between the fixing member and the pressing member, wherein the temperature sensor is attached to a recording material supplying unit, and is configured to detect a temperature of a recording material stored in the recording material supplying unit, and a fixing temperature is controlled based on the detected temperature, and wherein the detected temperature is fed back to control the fixing temperature and a nip width only in printing a first side of the recording material during duplex printing of the recording material.

9. The printing device according to claim 8, wherein a nip width of the fixing nip is controlled based on the detected temperature.

10. The printing device according to claim 8, wherein the recording material supplying unit includes a plurality of recording material supplying units;

the temperature sensor is attached to each of the recording material supplying units; and the fixing temperature and a nip width are controlled based on the temperature of the recording material detected by the temperature sensor attached to the recording material supplying unit that feeds a recording material for printing of the recording material supplying units.

11. The printing device according to claim 8, wherein the fixing temperature and a nip width are controlled based on an environmental temperature of the printing device and the detected temperature.

12. The printing device according to claim 8, wherein the temperature sensor detects a temperature of a recording material to be picked next as the temperature of the recording material stored in the recording material supplying unit.

13. The printing device according to claim 8, wherein the temperature sensor is a non-contact sensor.

14. An image forming apparatus comprising an electrophotographic printing device, the printing device including:

a fixing unit; and a temperature sensor, wherein the fixing unit includes a fixing member;

a pressing member pressed against the fixing member; and a heater configured to heat at least the fixing member of the fixing unit and the pressing member, the fixing unit configure to fix a toner image on a recording material to the recording material while carrying the recording material through a fixing nip formed between the fixing member and the pressing member, wherein the temperature sensor is attached to a recording material supplying unit, and is configured to detect a temperature of a recording material stored in the recording material supplying unit, and a fixing temperature is controlled based on the detected temperature, and wherein the detected temperature is fed back to control the fixing temperature and a nip width only in printing a first side of the recording material during duplex printing of the recording material.

* * * * *